United States Patent [19]

Hamilton

[11] 4,323,011

[45] Apr. 6, 1982

[54] ACTUATING STAMP WITH FREE-TURNING INKING ROLLER

[76] Inventor: Joel A. Hamilton, 101 Hardenburgh Ave., Demarest, N.J. 07627

[21] Appl. No.: 199,230

[22] Filed: Oct. 21, 1980

[51] Int. Cl.[3] ..... B41F 1/04

[52] U.S. Cl. ..... 101/305; 101/327; 101/359; 400/390; 400/394; 400/420; 400/432; 400/470

[58] Field of Search ..... 400/390, 394, 396, 405, 400/413, 414, 420, 432, 470; 101/305, 327, 291, 298, 301, 310, 324, 333, 334, 359, 41, 297

[56] References Cited

U.S. PATENT DOCUMENTS

| | | | |
|---|---|---|---|
| 352,237 | 11/1886 | Gally | 101/297 |
| 464,857 | 12/1891 | Cox | 101/291 X |
| 563,996 | 7/1896 | Baldwin | 101/301 |
| 1,262,826 | 4/1918 | Mitchell | 101/298 |
| 1,608,861 | 11/1926 | Putnam | 101/301 |
| 1,974,753 | 9/1934 | Robbins | 101/298 |
| 2,613,599 | 10/1952 | Rupp | 101/298 |
| 2,631,528 | 3/1953 | Wood | 101/297 X |
| 3,724,369 | 4/1973 | Gery et al. | 101/305 X |
| 4,048,913 | 9/1977 | Navi | 101/297 |

*Primary Examiner*—Edgar S. Burr
*Assistant Examiner*—Charles Pearson
*Attorney, Agent, or Firm*—Ralph R. Roberts

[57] ABSTRACT

There is shown an inking apparatus for stamping on a localized area, and with a speedy application, a selected reproduction to a travelling or advanced product. This inking roller is free-turning with a light brake to prevent free wheeling. A four-bar linkage is used with two eccentrics. One eccentric is preferably rotated with at least twice the revolutions of the other eccentric. The four-bar linkage carries on an extending end of a first bar the stamp which is moved into peripheral engagement of the inking roller and then to the surface of the product. The movement of the stamp is in a path prescribed by the eccentrics and the four-bar linkage. The stamp in its peripheral engagement with the inking roller causes said roller to be inched forward rotationally to present a fresh surface to the stamp when next brought to the inking roller.

12 Claims, 8 Drawing Figures

ACTUATING STAMP WITH FREE-TURNING INKING ROLLER

BACKGROUND OF THE INVENTION

1. Field of the Invention

With reference to the classification of art as established in and by the United States Patent Office the present invention is believed to be found in the general class entitled, "Printing" (Class 101) and in the subclass therein entitled, "Oscillating" (Subclass 297) and "Oscillating bed" (Subclass 298).

2. Description of the Prior Art

The prior art shows many inking roller devices of which many are directed toward and to typewriters and the desire to eliminate the ribbon usually provided. Some of these devices also are used in date applying machines or printers. The rollers so used or provided are usually moved by power means or rotated by and with connected means. The pertinent art is listed in a Prior Art Statement.

The several patented devices and others known to Applicant do not provide a fast actuation of a stamp head and/or inking of this stamp by a freely-turning ink applying roller. The apparatus to be hereinafter more fully described employs a four-bar linkage in which two of the bars are connected to and are eccentrically actuated by shafts that are rotated by and with transport apparatus. The inking of the stamp is by a freely-turning roller that is inched along by engaged contact by the moved stamp member.

SUMMARY OF THE INVENTION

This invention may be summarized, at least in part, with reference to its objects. It is an object of this invention to provide, and it does provide, an apparatus in which a freely-turning inking roller is contacted by a stamp, usually of rubber or plastic. This stamp is carried by a four-bar linkage moved with and by two eccentric actuators that pivotally support each linkage member. The eccentric members are each driven by associated means and in a timed relationship provide a rapid advance and withdrawal of the linked stamp into engagement with the item to be stamped.

In brief, this apparatus has the stamp bar pivotally mounted intermediate its length by a fourth pivoted bar. This fourth bar is pivotally secured to the support at one end thereof and at its midlength is moved by a third bar. Said third bar is pivotally mounted on a eccentric rotated by a shaft. This shaft is rotated at a speed that is twice that of a companion and different shaft. A second bar has one end pivotally secured to another eccentric and the other end is pivotally secured to the end of the bar carrying the stamp at and on its other end.

This apparatus is driven in timed relationship to the advancement of a product. Often this product is a web or a package carried in and by a web. Boxes or similarly packaged products may be identified by a stamping of either a date or code. Conveyor means with positive placement of said packages is contemplated. The inking wheel has a periphery that carries an inking means. Often this periphery is a foam material to which a fluid ink is applied. This wheel is a rotated disk which is more-or-less free to turn but a small brake is usually provided to prevent undue rotation. Each tangential engagement of the inking wheel by the stamp causes an inching rotation of this wheel.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of a stamp with a free-turning inking roller as adopted for use with identification of a product and showing a preferred means for actuating said stamp. This specific embodiment has been chosen for the purposes of illustration and description as shown in the accompanying drawings wherein:

BRIEF DESCRIPTION OF THE DRAWINGS

In the following description and in the claims various details are identified by specific names for convenience. These names are intended to be generic in their application. Corresponding reference characters refer to like members throughout the several figures of the two sheets of drawings.

DESCRIPTION OF THE PREFERRED EMBODIMENT

Figure 1:
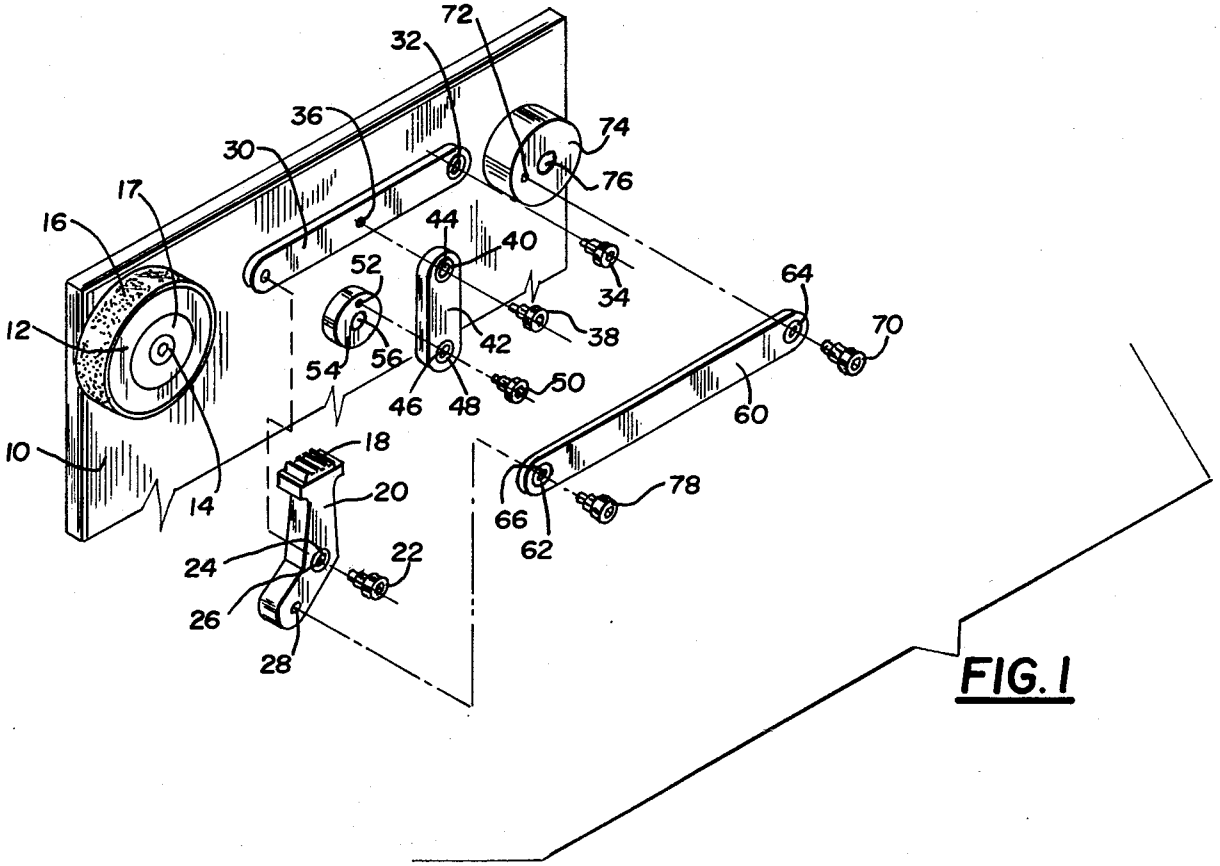
FIG. 1 represents an exploded isometric view of the several components and their relationship to each other in the stamping and inking apparatus.

Referring now to the drawings in particular there is shown in FIG. 1 a four-bar linkage in an exploded, isometric view which shows the arrangement of the several components. As shown, a four-bar linkage is diagrammatically represented with the linkage moved by two eccentrics, one eccentric driven at twice the rotational speed of the other. These eccentrics are positively driven an a timed relationship to each other by and with mechanism not shown and by which the produce to be stamped is moved or advanced. The product may be a carton, a package or a web of material. The stamped application may be a code or date indicia applied in a timed relationship to the product movement.

Embodiment of FIG. 1

As shown, the apparatus is carried by a support 10 which for the purpose of explanation is a plate. An ink roller or wheel 12 is carried on a shaft 14. An outer covering 16 is a sponge or similar material adapted to retain ink and to act as a stamp pad. This roller or wheel has a friction or brake means to prevent unwanted rotation. This brake means does not prevent turning. Usually this brake is provided by a plastic washer 17 in slight frictional engagement with the wheel but may be a "Belleville" spring or other known brake means. The shaft may also be mounted in a bearing and a brake applied to the now rotatable shaft. As and of itself the brake may be conventional but as employed in the present inking apparatus provides a novel actuation. A stamp 18 is carried by a bar 20 and is secured to one end thereof. This stamp is usually partially resilient such as a rubber or plastic molding and is attached by adhesive or clamp means which are conventional and well known.

Bar 20 is carried by a shouldered cap screw 22 which passes through a bearing 24 mounted and carried in a through aperture 26 at midlength of the stamp carrying bar 20. The lower end of said bar has a threaded aperture 28. Cap screw 22 is secured to a left end of a bar 30 whose other end carries and is carried by a bearing 32. A cap screw 34 passes through this bearing 32 and pivotally retains this end of the bar 30 to the support 10. Bar 30 has a threaded aperture 36 provided at its midpoint. A cap screw 38 passes through a bearing 40 carried and mounted in a short bar 42. This bearing 40 is secured in a through hole 44 in one end of said bar. This same bar has a through aperture 46 in which is mounted a bearing 48. A cap screw 50 passes through this bearing and into a threaded hole 52 in an eccentric 54. Eccentric 54 is carried by a shaft 56 which is rotated at a selected speed by mechanism not shown.

The linkage also includes another bar 60 having bearings 62 and 64 mounted and secured in apertures 66 and 68. A cap screw 70 passes through the bearing 64 and into a threaded aperture 72 in an eccentric 74. A shaft 76 carries this eccentric and positively rotates this shaft at one-half the speed of the eccentric 54. Eccentric 74 is driven by the same mechanism that drives eccentric 54. Cap screw 78 passes through bearing 62 and into threaded aperture 28 in bar 20. The phantom lines indicate the assembly of the four-bar apparatus as shown in operation in FIGS. 2 through 8.

Step-By-Step Actuation as in FIGS. 2 through 8

Figure 2:
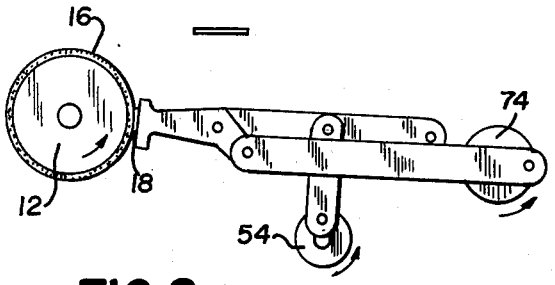
FIG. 2 represents a side view, partly diagrammatic, and showing the inking apparatus with the stamp engaging and being inked by a rotatable inking wheel.

As seen in FIGS. 2 through 8, the apparatus providing the stamping of the item is shown in a step-by-step motion. In FIG. 2, the stamp 18 is shown in engagement with roller or wheel 12. In its contact movement the stamp engages the outer covering 16 sufficiently to ink the stamp and at the same time to rotate the wheel 12. It is to be noted that eccentric 54 is at twelve o'clock and eccentric 74 is at three o'clock. Stamp 18 is in engagement with wheel 12.

Figure 3:
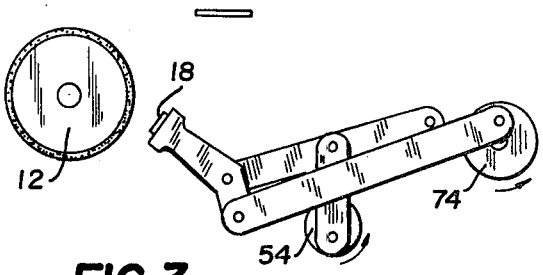
FIG. 3 represents a side view of the apparatus of FIG. 2 with the right eccentric moved counterclockwise about ninety degrees and the other eccentric moved about one hundred-eighty degrees and drawing the stamp away from the inking wheel.

As seen in FIG. 3, the eccentric 54 has moved counterclockwise to six o'clock and eccentric 74 has also moved counterclockwise one-quarter revolution. The stamp 18 has been moved by the linkage away from the wheel 12.

Figure 4:
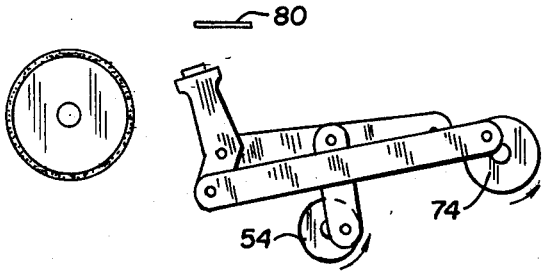
FIG. 4 represents a side view of the apparatus of FIG. 4 with the stamp now being moved toward a surface to be stamped and identified by said applied indicia.

As seen in FIG. 4, the eccentric 54 has moved about ninety degrees further counterclockwise to cause the stamp to move toward a position at which a product 80 is to be stamped. The eccentric 74 has moved about one-eighth revolution also counterclockwise since eccentric 74 travels at half the speed (revolutions) of eccentric 54. The stamp 18 is approaching the surface of product 80 at a comparatively rapid rate.

Figure 5:
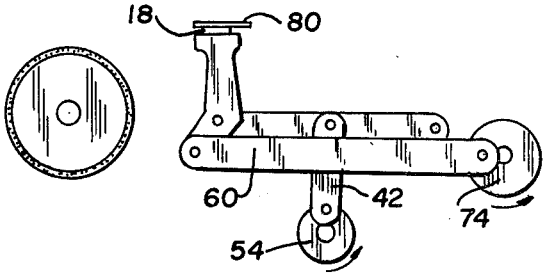
FIG. 5 represents a side view of the apparatus of FIG. 4 with the stamp now advanced to engaging condition whereat the stamp is pressed into the product to be identified.

In FIG. 5, the stamp 18 has reached the surface of product 80 and the eccentric 54 has now made a complete revolution. Eccentric 74 has made a half revolution whereby the fourth bar 60 has moved to the left and the eccentric 54 has moved short bar 42 to its upper extent. The stamp 18 is at its upper limit of travel.

Figure 6:
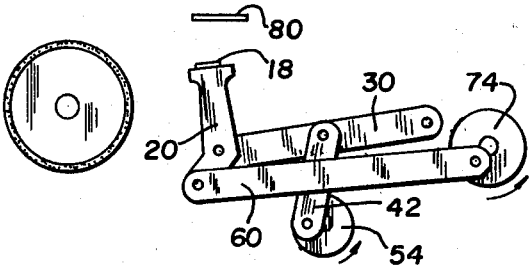
FIG. 6 represents a side view of the apparatus of FIG. 5 with the stamp now being moved away from the product surface.

In FIG. 6, the eccentric 54 has moved about ninety degrees from the position of FIG. 5 and at the same time eccentric 74 has moved the fourth bar from its extreme leftward position. The stamp 18 has moved away from the product surface 80.

Figure 7:
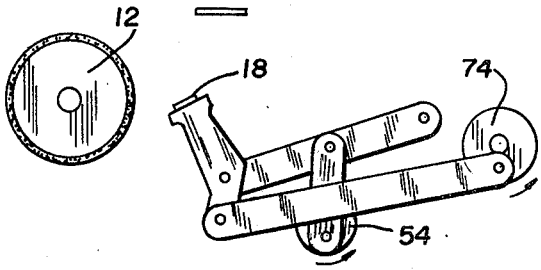
FIG. 7 represents a side view of the apparatus of FIG. 6 with the stamp at its full withdrawal from the stamped surface and ready for movement toward the inking wheel.

In FIG. 7 the eccentric 54 is shown at its six o'clock position whereas the eccentric 74 is also at the six o'clock position. The stamp 18 is now at its low point and ready to approach the inking wheel or roller 12.

Figure 8:
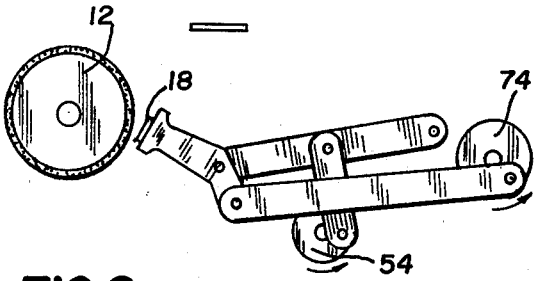
FIG. 8 represents a side view of the apparatus of FIG. 7 with the stamp now approaching the inking wheel.

In FIG. 8 the eccentric 54 has reached the three o'clock position and the eccentric 74 has reached the four-thirty o'clock position. The stamp 18 is approaching the inking wheel 12 from the right and below.

Inking of the stamp 18 is achieved when the stamp 18 again engages the wheel 12 as in FIG. 2.

FIGS. 2 through 8 are partly diagrammatic and depict step-by-step motions of the four-bar linkage. During the actuation of the linkage mechanism the product 80 is usually carried forwardly by a conveyor means and at a given speed. The eccentric 74 moves at a selected speed and in the manner of a Pitman arm cycles fourth bar 60 in a prescribed path. Eccentric 54 also is moved in the manner of a Pitman arm and at twice the rate of revolutions as eccentric 74. This eccentric moves only short bar 42. Bar 30 is pivotally secured at its right end to the support 10 and at its left end is pivotally secured to the stamp bar 20 at its midpoint.

It is to be noted that the four bars all show bearings mounted therein for assuring pivotal movement with the minimum of effort. Shoulder screws pass through these bearings and into threaded holes in either the support or bar members. The bearings are contemplated to have slightly longer inner race and shaft retainers so that the heads of the screws engage only the extended portion without affecting the operation of the bearing. This is not to preclude the use of other bearing means and/or washers. It is also contemplated that substitution for the use of shouldered cap screws may be made as by studs. Short shaft portions with washers are cotter pins can also be used. The embodiment shown is merely a matter of preference and illustration and is presented as an easily assembled apparatus.

The support 10 is usually a part of the apparatus and is merely illustrative of the corresponding position for returning the several elements. The eccentrics 54 and 74 are driven in a timed relationship to the advancement of the product. A timing means such as a photo-electric apparatus may be employed or other timing means may be utilized. It is very important that the two eccentrics be driven by the same mechanism or at least in timed concert. The shafts 56 and 76 may be driven by a roller chain and sprockets, by gears or combinations thereof. The two eccentrics are shown as being rotated in the same direction but as long as the eccentric moving the short bar is moved at twice the speed of the other eccentric, this second may be moved in a reverse direction.

The stamp 18 is preferably attached by cement or by a clamp means but a plastic arm with a molded stamp may be provided if the indicia is not to be changed. The resiliency of the stamp 18 will and is determined by the product to have the ink impression transferred thereto. If and when the product is a carboard overwrap the stamp 18 is usually at least partially resilient. Where and when the product is soft or spongy such as a pouch of plastic the stamp 18 may be much more firm. The inking wheel has a retaining surface which is a resilient tire-like peripheral member.

It is also to be noted that the small eccentric 54 has moved one hundred-eighty degrees from FIG. 2 to FIG. 3. The movement of the stamp 18 from FIG. 2 to FIG. 3 is to the right and slightly down, much like the showing of FIG. 8. It is realized that the Pitman motion embodied by the eccentrics 54 and 74 cause the four-bar linkage to move in slow to fast motions. Intermediate showings have not been illustrated or described since the step-by-step representations of FIGS. 2 through 8 are believed sufficient to illustrate the actuation.

The showing of bearings in the several bars does not preclude the use of hardened bars with precisely bored or reamed holes or the use of hardened sleeve-type bearings such as are used in pantograph-type apparatus. The arrows indicating that shafts 56 and 76 are preferably rotated in the same direction does not restrict the direction of motion since the same or opposite directions may be employed. It is very desirable that eccentric 54 travel at twice the revolutions of eccentric 74. Other ratios may be established but at least a doubling of the eccentric revolutions of 54 and 74 is desirable.

The above described apparatus provides a simple yet very efficient stamp applying apparatus that is inexpensive, positive and may be used for codes and/or date stamping of a series of like products. The stamp is easily changed and inking is easily achieved by an applicator supply to the peripheral tire or outer covering 16 on wheel 12. It is also to be noted that the inking apparatus is usually positioned above the product to stamp the upper surface but the stamp apparatus may be positioned to stamp a side of the product whereat the apparatus is positioned accordingly.

Terms such as "left", "right", "up", "down", "bottom", "top", "front", "back", "in", "out", "clockwise", "counterclockwise" and the like are applicable to the embodiment shown and described in conjunction with the drawings. These terms are merely for the purposes of description and do not necessarily apply to the position in which the stamp apparatus and free-turning inking roller may be constructed or used.

While a particular embodiment of the apparatus has been shown and described it is to be understood the invention is not limited thereto since modifications may be made within the scope of the accompanying claims and protection is sought to the broadest extent the prior art allows.

What is claimed is:

1. Apparatus for applying to a local area and at and with a precise movement an inked stamp reproduction, said apparatus including:

(a) a support means;

(b) a non-powered inking roller rotatably carried on and by a shaft secured to said support, said roller having a periphery adapted to receive, retain and transfer ink to a printing means when brough into contact therewith;

(c) a fourth bar having securing means at both ends thereof and an intermediate mounting means provided by said fourth bar, one end of said fourth bar pivotally mounted to the support means;

(d) a first bar having an extending end and a pivotal mounting means intermediate its ends, said pivotal mounting means attached to the other unsecured end of the fourth bar which is moved by said fourth bar as it is moved around said pivotally secured end, said first bar also having a securing means at the other end of the first bar;

(e) a first eccentric carried by said support means, said eccentric carried by a first shaft and rotated at a given and selected speed;

(f) a second bar having securing and pivoted means formed and provided at each end thereof, one end of said second bar secured to the first eccentric to move in a circular path as established by the eccentric, the other end of said second bar pivotally secured to the end of the first bar;

(g) a second eccentric carried by said support means, said eccentric carried by a second shaft and rotated at a speed that is at least twice the angular speed of the first eccentric;

(h) a third bar having securing and pivoted means formed and provided at each end thereof, one end of said third bar pivotally secured to said second eccentric so as to move in a circular path as established by said eccentric, the other end of said third bar pivotally secured to the intermediate mounting means of said fourth bar;

(i) a stamp having means for securing said stamp to the extending end of said first bar, and (j) means to advance and move a product in way of said stamp when said stamp is moved by the eccentric toward and to the surface of the product, the movement of the stamp being in a prescribed path as controlled by the two eccentrics, the stamp rapidly and momentarily brought to the product to be marked, the stamp in its travel path also brought to wiping contact of the periphery of the inking roller whereat ink is applied to the stamp and the engagement of the stamp with the roller periphery during inking causing the roller to be inched forward rotationally to present a fresh surface to the stamp when next brought to the inking roller.

2. Apparatus for applying an inked stamp to a localized area as in claim 1 in which the inking roller mounting means includes a brake means by which said roller is inhibited from free-wheeling.

3. Apparatus for applying an inked stamp to a localized area as in claim 1 in which the pivotal mounting in each bar includes an anti-friction bearing.

4. Apparatus for applying an inked stamp to a localized area as in claim 1 in which the eccentric shafts are rotated in the same direction.

5. Apparatus for applying an inked stamp to a localized area as in claim 4 in which the direction of the eccentric shafts is counterclockwise.

6. Apparatus for applying an inked stamp to a localized area as in claim 4 in which the direction of the eccentric shafts is clockwise.

7. Apparatus for applying an inked stamp to a localized area as in claim 1 in which the pivotal and securing means includes shouldered cap screws each having a threaded end which is mounted in a compatibly formed threaded aperture.

8. Apparatus for applying an inked stamp to a localized area as in claim 1 in which the inking roller has a sponge or foam-type, tire-like peripheral cover.

9. Apparatus for applying an inked stamp to a localized area as in claim 1 in which the stamp has a slightly resilient face.

10. Apparatus for applying an inked stamp to a localized area as in claim 9 in which the means for securing the stamp is an adhesive.

11. Apparatus for applying an inked stamp to a localized area as in claim 9 in which the means for securing the stamp is a clamp means.

12. Apparatus for applying an inked stamp to a localized area as in claim 1 in which the first eccentric is rotated at one-half the angular speed of the second eccentric.

* * * * *